US007182378B2

(12) United States Patent
Inomata et al.

(10) Patent No.: US 7,182,378 B2
(45) Date of Patent: Feb. 27, 2007

(54) ASSIST TOOL FOR CHOPSTICKS

(75) Inventors: Yuko Inomata, Saitama (JP); Kenshun Ishii, Tokyo (JP)

(73) Assignee: Combi Corporation, Tokyo (JP)

( * ) Notice: Subject to any disclaimer, the term of this patent is extended or adjusted under 35 U.S.C. 154(b) by 0 days.

(21) Appl. No.: 11/014,689

(22) Filed: Dec. 20, 2004

(65) Prior Publication Data

US 2005/0134065 A1 Jun. 23, 2005

(30) Foreign Application Priority Data

Dec. 19, 2003 (JP) ..... 2003-423568

(51) Int. Cl.
*A47G 21/10* (2006.01)

(52) U.S. Cl. ..... 294/99.2

(58) Field of Classification Search ..... 294/99.2, 294/1.1; *A47G 21/10*
See application file for complete search history.

(56) References Cited

U.S. PATENT DOCUMENTS 3,323,825 A 6/1967 Arima
5,611,586 A * 3/1997 Kang ..... 294/99.2
5,911,462 A * 6/1999 Hui ..... 294/99.2
2002/0096899 A1 7/2002 Kang

FOREIGN PATENT DOCUMENTS

JP 10-225361 8/1998
JP 10225361 * 8/1998
JP 09122187 A * 5/1999
JP 2001-017298 1/2001
JP 2001017298 A * 1/2001
JP 2003-275085 9/2003

* cited by examiner

*Primary Examiner*—Dean J. Khamer
*Assistant Examiner*—Esther Onyinyechi Okezie
(74) *Attorney, Agent, or Firm*—Young & Thompson

(57) ABSTRACT

There is provided an assist tool for chopsticks comprising: an adapter which couples upper and lower chopsticks such that distal end portions thereof can be opened and closed about rear end portions thereof serving as fulcrums; and a supporter which is fitted to a vicinity of a base of a user's forefinger to support the adapter on the base.

6 Claims, 7 Drawing Sheets

ASSIST TOOL FOR CHOPSTICKS

BACKGROUND OF THE INVENTION

The present invention relates to an assist tool for chopsticks used for training the way to hold chopsticks.

As an assist tool of this type, for example, there has been known an assist tool where a coupling member made from elastic material such as urethane rubber is disposed between upper and lower chopsticks so that distal ends of the chopsticks can be opened and closed while a proper spacing is being maintained between rear ends of the chopsticks (for example, refer to Japanese Patent Application Laid-Open (JP-A) No. 2003-275085).

The above described assist tool is excellent in that the proper spacing between upper and lower chopsticks can be maintained so that a user can acquire the proper spacing naturally. However, such a case occurs sometimes that a toddler beginning to use chopsticks cannot make judgment about a portion of his or her hand which holds two chopsticks and he or she does not make progress in how to use chopsticks to his or her satisfaction due to unstableness on chopsticks holding. That is, in how to hold chopsticks which is correct, a user should push a lower chopstick to a portion of a hand portion near to his or her thumb and the vicinity of the base of his or her forefinger to fix the same. Therefore, when the user holds the lower chopstick even in the above-described assist tool, he or she can hold the upper chopstick naturally. However, unless the user can master such a positional relationship between the fingers and the chopsticks, the user may hold the upper and lower chopsticks unstably.

SUMMARY OF THE INVENTION

In view of the above circumstances, one object of the present invention is to provide an assist tool for chopsticks which allows even a user who is untrained to use chopsticks to hold chopsticks stably and correctly and which can develop a proper assistant effect according to a learning level of a user.

In order to achieve the above object, according to one aspect of the present invention, there is provided an assist tool for chopsticks comprising: an adapter which couples upper and lower chopsticks such that distal end portions thereof can be opened and closed about rear end portions thereof serving as fulcrums; and a supporter which is fitted to a vicinity of a base of a user's forefinger to support the adapter on the base.

According to the above assist tool for chopsticks, a user can hold the upper and lower chopsticks in a proper positional relationship through the adapter and he or she can support the adapter near to the base of his or her forefinger by utilizing the supporter. Accordingly, even a person who is unskilled in using chopsticks can hold the upper and lower chopsticks stably at a proper positional relationship. When a toddler or the like learns how to hold chopsticks, a rapid progress can be achieved.

In the above aspect of the present invention, the supporter may be attachable to and detachable from the adapter. When the adapter is attachable and detachable, a user can make selection about whether or not an assistant effect obtained by the adapter, that is, an effect that the user holds the upper and lower chopsticks near to the base of his or her forefinger stably should be utilized in accordance with the necessity of the user.

In the above aspect of the present invention, an attaching position of the supporter to the adapter may be changeable about the fulcrums. By changing the attaching position of the supporter about the fulcrums, the orientation of the adapter to the upper and lower chopsticks can be adjusted properly in both of a case that a user holds the chopsticks with his or her right hand and a case that he or she holds the chopsticks with his or her left hand. Such a constitution can allow adjustment for differences among individuals.

In the above aspect of the present invention, the supporter may include a finger fitting portion curved so as to be fitted to a portion of a hand near the base of the forefinger. By providing such a finger fitting portion, a user can further fit the supporter to the vicinity of the base of the forefinger to further stabilize supporting of the adapter through the supporter, thereby improving a supporting effect obtained by the supporter.

In the above aspect of the present invention, the upper and lower chopsticks may be attachable to and detachable from the adapter. By detaching the adapter from the chopsticks, a user can train how to hold chopsticks without utilizing any assistant effect or function. Especially, when the adapter is attachable and detachable, a user can train how to hold chopsticks in each of a stage where the user uses the adapter and supporter, a stage where he or she uses only the adapter, and a stage where he or she does not use even the adapter. Accordingly, a user can learn about how to use chopsticks further naturally and reasonably as compared with the conventional assist tool whose use or nonuse can only be selected by a user.

In the assist tool for chopsticks according to the above aspect of the present invention, spring means for urging the chopsticks such that their distal end portions is opened may be provided on the adapter. When such spring means is provided, since a sufficient spacing can be obtained between upper and lower chopsticks when a user holds the chopsticks. Therefore, the user can put this or her fingers to the upper and lower chopsticks naturally and reasonably.

DETAILED DESCRIPTION OF THE PREFERRED EMBODIMENT

Figure 1:
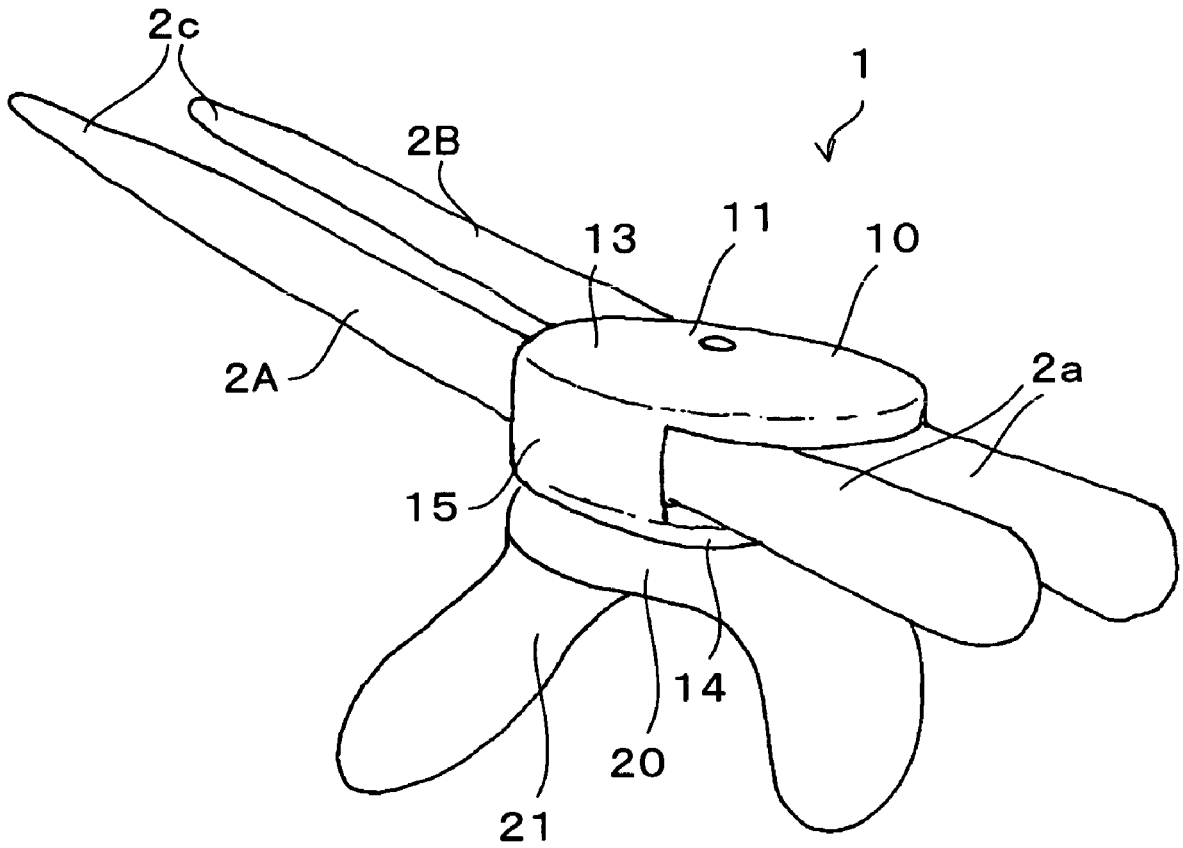
FIG. 1 is a perspective view of an assist tool for chopsticks according to one embodiment of the present invention.
Figure 2:
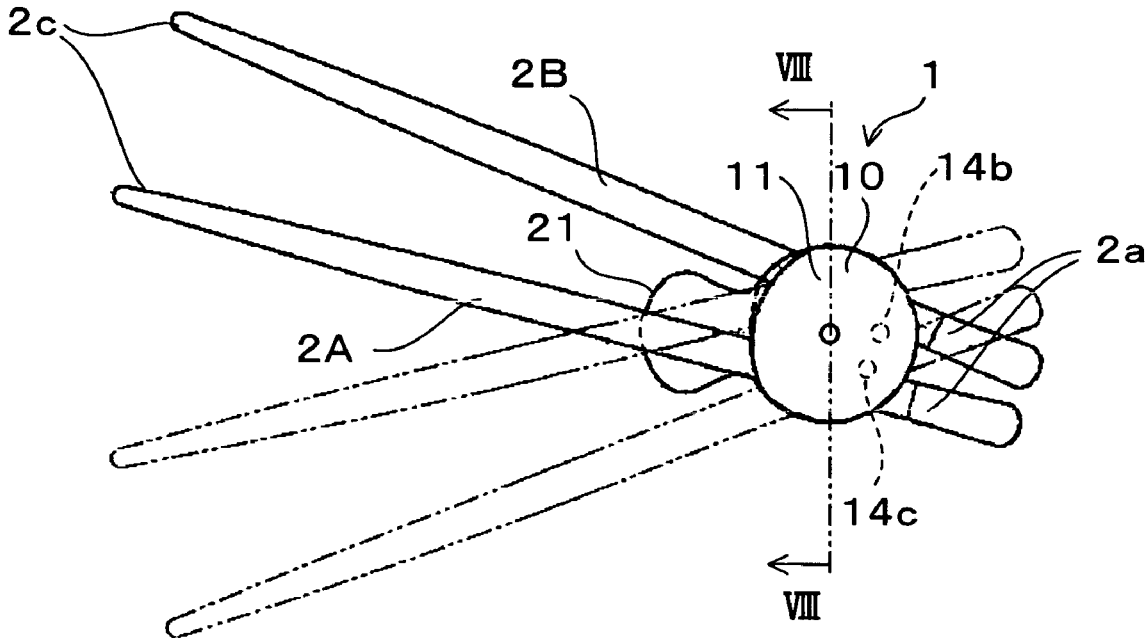
FIG. 2 is a plan view of the assist tool for chopsticks.
Figure 3:
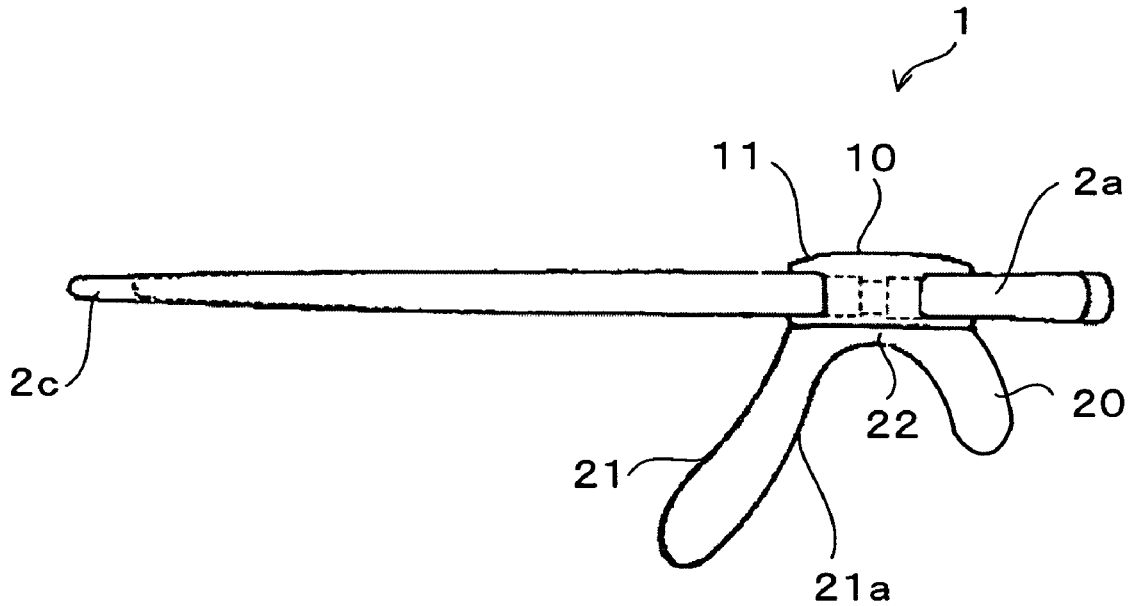
FIG. 3 is a front view of the assist tool for chopsticks.

FIGS. 1 to 3 show one embodiment of an assist tool for chopsticks to which the present invention is applied. As shown in FIGS. 1 to 3, an assist tool 1 is provided with an adapter 10 for adapting a lower chopstick 2A and an upper chopstick 2B to the assist tool 1, and a supporter 20 for supporting the adapter 10 on a predetermined position of a hand of a user. Incidentally, the terms "upper" and "lower" of the upper and lower chopsticks 2A and 2B are based upon a right-handed user. When it is unnecessary to discriminate the chopsticks 2A and 2B from each other, they may be described as the chopstick(s) 2 in this text.

Figure 4:
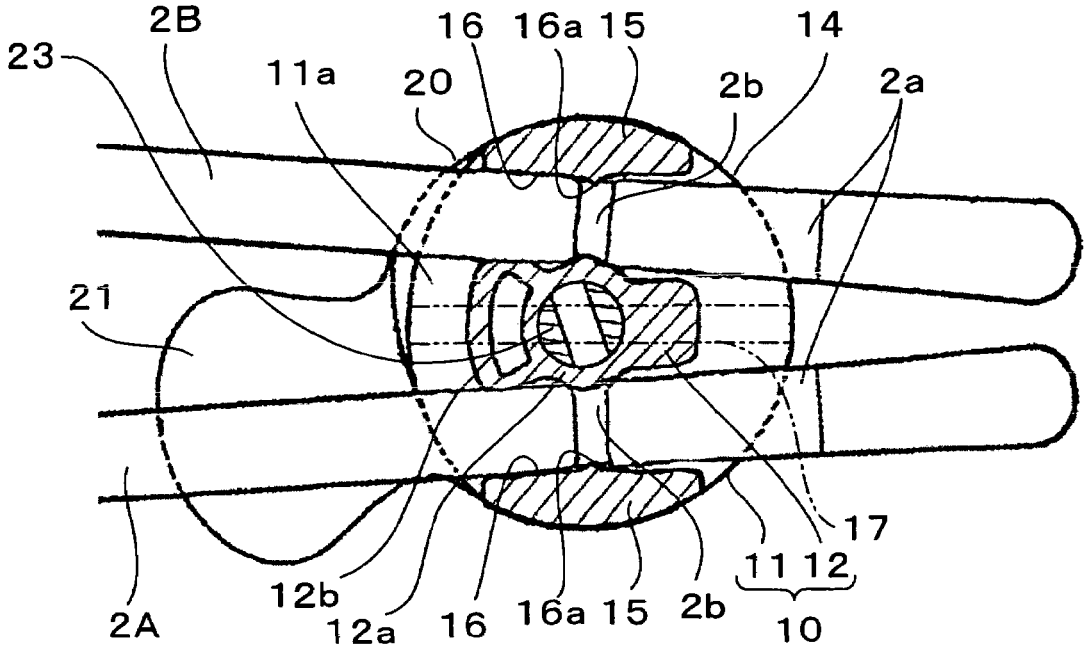
FIG. 4 is a view showing a constitution of an inner structure of an adapter of the assist tool for chopsticks.

As shown in FIG. 4, the adapter 10 is provided with an adapter main body 11 and an adapter spring (spring means) 12 disposed inside the adapter main body 11. As apparent from FIG. 1 and FIG. 4, the adapter main body 11 has an upper plate 13 and a lower plate 14 which are generally circular, and a pair of side walls 15 which connect the plates 13 and 14 to each other with a predetermined spacing. The upper plate 13, the Lower plate 14, and the side walls 15 can be unitized, for example, by injection molding using resin as material. The side walls 15 are provided in fixed ranges of a periphery of the adapter 10, so that a chopstick inserting space 11*a* whose both end are opened is formed inside the adapter 10.

Inner faces of the sidewalls 15 are constituted as chopstick receiving faces 16 which support the chopsticks 2 from their outsides. On central portions of the chopstick receiving faces 16, there are formed protrusions 16*a* engaged with annular recesses 2*b* provided at rear end portions 2*a* of the chopsticks 2. A spacing between the chopstick receiving faces 16 is set to be minimal at a position where the protrusions 16*a* are provided. The respective chopstick receiving faces 16 are formed with slopes such that the spacing between the chopstick receiving faces 16 gradually increases from the protrusions 16*a* to both ends of the chopstick receiving faces 16. Incidentally, it is not essential to provide such slopes on the chopstick receiving faces 16, but a margin allowing the chopsticks 2 inserted between the chopstick receiving faces 16 and the adapter spring 12 to open in a proper range may be provided between the respective chopsticks 2A and 2B and the chopstick receiving faces 16. Further, it is not essential to provide the recesses 2*b* in the chopsticks 2, and the adapter can be applied to even chopsticks which have not such recesses 2*b*.

The adapter spring 12 is made of elastic body such as elastomer. The adapter spring 12 has a hollow bearing portion 12*a* disposed at a central portion between the upper plate 13 and the lower plate 14 and a spring portion 12*b* disposed nearer to the distal end side of the chopsticks than the bearing portion 12*a*. Clearances which allow the chopsticks 2 to be inserted are formed between the bearing portion 12*a* of the adapter spring 12 and the chopstick receiving faces 16. By inserting the chopsticks 2A and 2B into these clearances, the chopsticks 2A and 2B are coupled to each other via the adapter 10 in a state that each of the chopsticks 2A and 2B has been sandwiched between the bearing portion 12*a* of the adapter spring 12 and the protrusion 16*a* of each chopstick receiving face 16 properly. In this case, the bearing portion 12*a* is interposed between the respective rear end portions of the chopsticks 2A and 2B so that a fixed spacing is secured between the rear end portions 2*a* of the chopsticks 2A and 2B, and the distal end portions 2*c* of the chopsticks 2A and 2B can be opened and closed about the rear end portions 2*a* (more specifically, positions of the chopsticks held between the adapter spring 12 and the respective protrusions 16*a* of the chopstick receiving faces 16) serving as fulcrums. Incidentally, the spring portion 12*b* of the adapter spring 12 is slightly compressed in a state that the chopsticks 2 has been inserted into the adapter 10, so that the chopsticks 2A and 2B are urged by an elastically restoring force against the compression in a direction in which distal ends of the chopsticks 2 are opened. As shown with an imaginary line in FIG. 4, a convex line 17 is provided on an inner face of the upper plate 13. By engagement of the convex line 17 and the adapter spring 12 with each other, the adapter spring 12 is prevented from rotating in a circumferential direction, and the orientation of the adapter spring 12 is not changed even if the chopsticks 2 are removed from the adapter 10.

Figure 5:
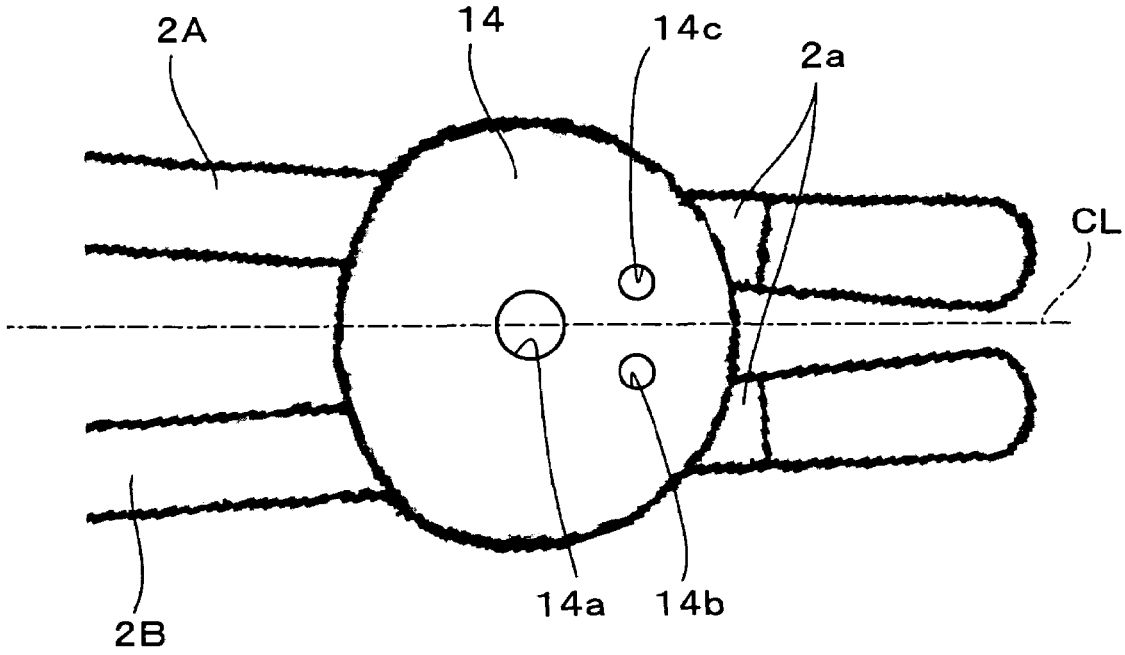
FIG. 5 is a bottom view of the adapter of the assist tool for chopsticks.

As shown in FIGS. 2 and 5, through-holes 13*a* and 14*a* are formed at the centers of the upper plate 13 and the lower plate 14, respectively. As shown in FIG. 5, a pair of detent holes 14*b* and 14*c* are formed on the lower plate 14 symmetrically about a virtual center line CL extending in a longitudinal direction of the chopsticks inserting space 11*a* through the center of the through-hole 14*a*. The through-holes 13*a*, 14*a* and the detent holes 14*b*, 14*c* are formed for attaching the supporter 20 to the adapter.

Figure 6:
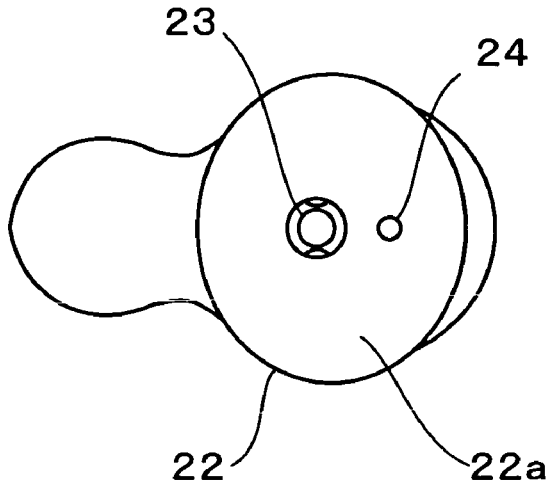
FIG. 6 is a plan view of a supporter utilized in the assist tool for chopsticks.
Figure 7:
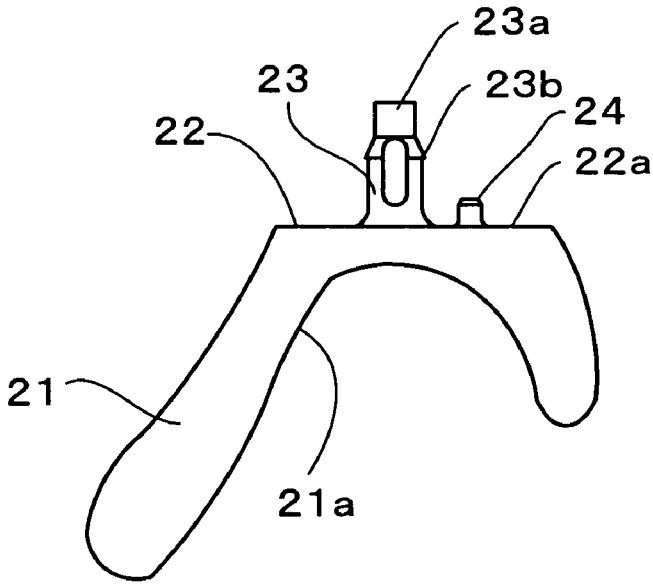
FIG. 7 is a front view of the supporter utilized in the assist tool for chopsticks.

As shown in FIGS. 6 and 7, the supporter 20 is provided with a finger fitting portion 21 and a supporting portion 22 provided thereon. The finger fitting portion 21 has a finger putting face 21*a* curved in a generally U shape so as to fit to the vicinity of a forefinger of a user. The supporting portion 22 is formed substantially in a disc shape to have size and shape generally equal to those of the adapter 10, and a coupling shaft 23 is provided on a central portion of an upper face 22*a* thereof and a stopper shaft 24 is provided at a position deviated from the coupling shaft 23 thereon. A small diameter portion 23*a* is provided at an upper end of the coupling shaft 23, and a flange portion 23*b* for serving to prevent the supporter 20 from falling off properly is provided on a proximal end portion of the small diameter portion 23*a*. Incidentally, the supporter 20 may entirely be made from resin, but the coupling shaft 23 or the stopper shaft 24 of the supporting portion 22 which requires rigidity is made from hard resin and the finger fitting portion 21 may be integrally molded from flexible elastomer with a high adaptability to a finger or a hand or the like utilizing the coupling shaft 23 or the stopper shaft 24 as an insert.

Figure 8:
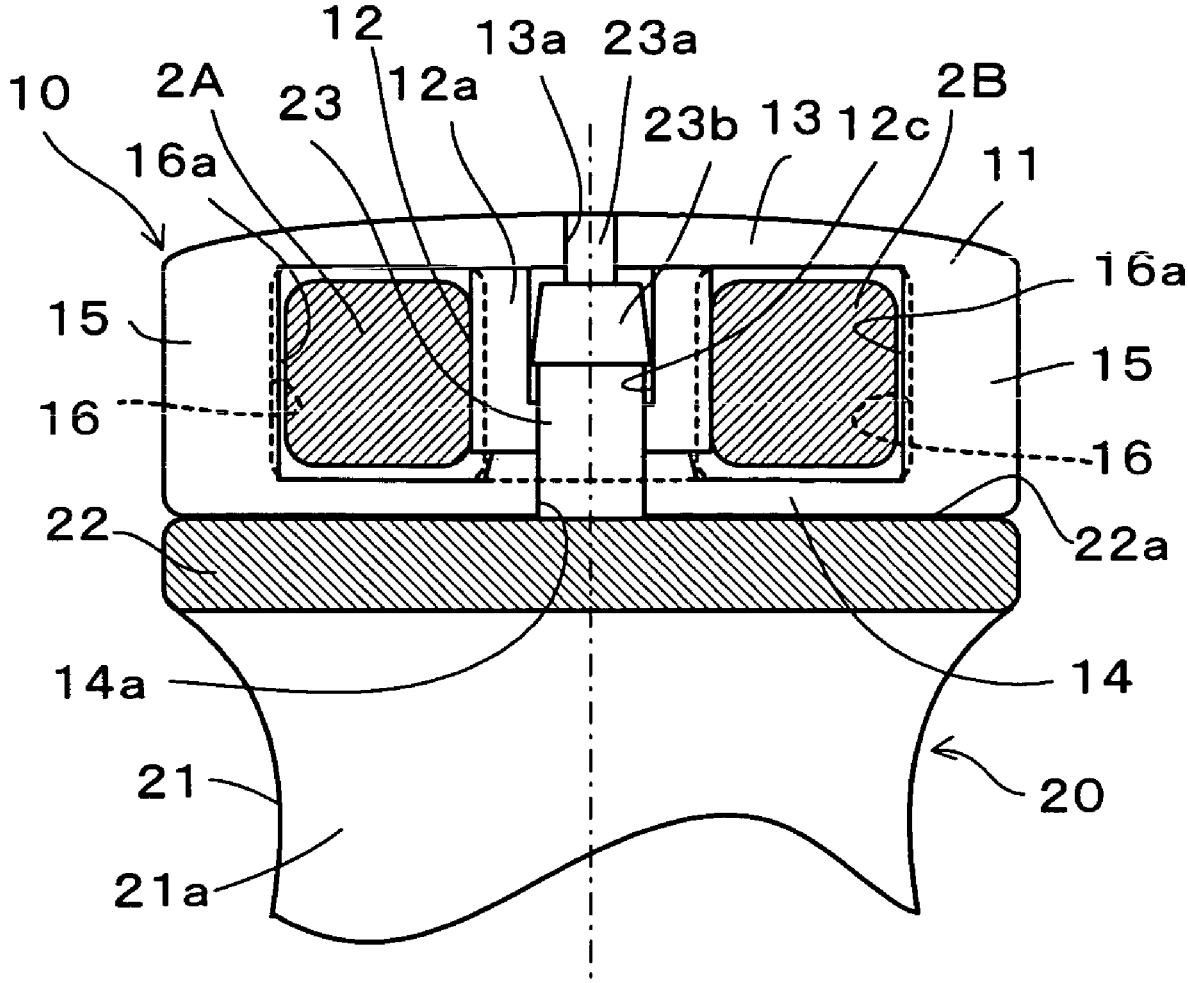
FIG. 8 is a sectional view of a coupling portion between the adapter and the supporter taken along line VIII—VIII in FIG. 2.

How to use the assist tool 1 constituted in the above manner will be explained. When in the case such that a toddler learns how to use chopsticks for the first time, as shown in FIG. 4, the chopsticks 2A and 2B are attached to the adapter 10, as shown in FIG. 8, the coupling shaft 23 of the supporter 20 is inserted into the through-hole 14*a* of the lower plate 14 of the adapter main body 11 and the center hole 12*c* of the adapter spring 12, and the small diameter portion 23*a* is further fitted into the through-hole 13*a* of the upper plate 13. At that time, the stopper shaft 24 is fitted into either one of the detent holes 14*b* and 14*c* of the lower plate 14 in the following manner. That is, when a user (the toddler) holds the chopsticks with his or her right hand, the stopper shaft 24 is fitted into the lower side detent hole 14*b* in FIG. 5, while the stopper shaft 24 is fitted into the upper side detent hole 14*c* in FIG. 5, when the user holds the chopsticks with his or her left hand. Thereby, the positional relationship between the chopsticks 2 and the finger fitting portion 21 in a circumferential direction varies. Considering that the position of the finger fitting portion 21 is fixed in FIG. 2, when the stopper shaft 24 is fitted into the detent hole 14*b*, the chopsticks 2 extend in a direction shown with a solid line, while the chopsticks 2 extend in a direction shown with an imaginary line, when the stopper shaft 24 is fitted into the detent hole 14*c*. In the following, it is assumed that the stopper shaft 24 is fitted into the detent hole 14*b* such that the user holds the chopsticks 2 with his or her right hand.

Figure 9:
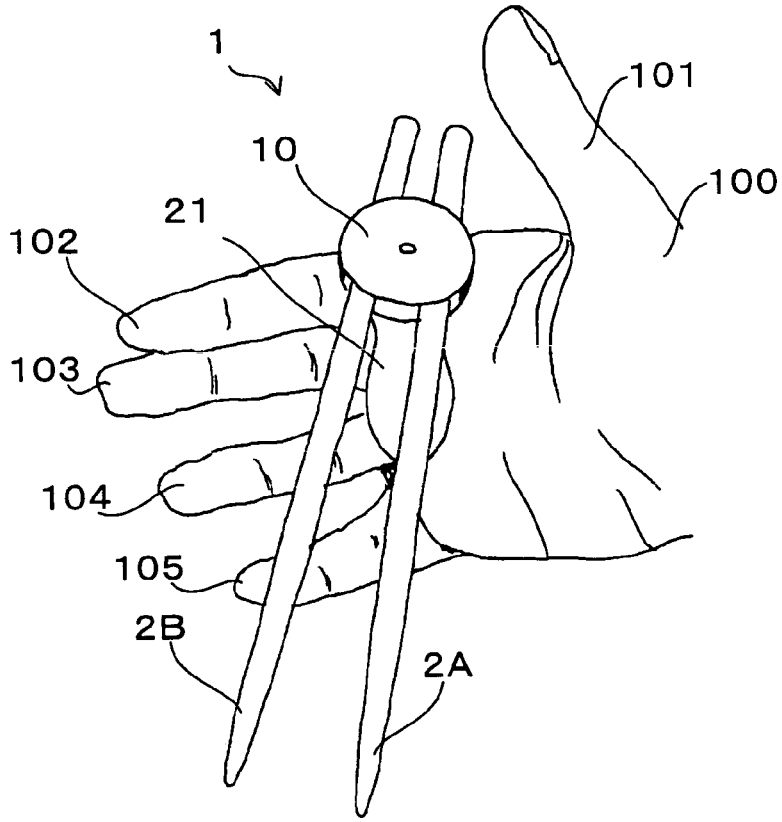
FIG. 9 is a view showing a state where a user uses the assist tool for chopsticks.
Figure 10:
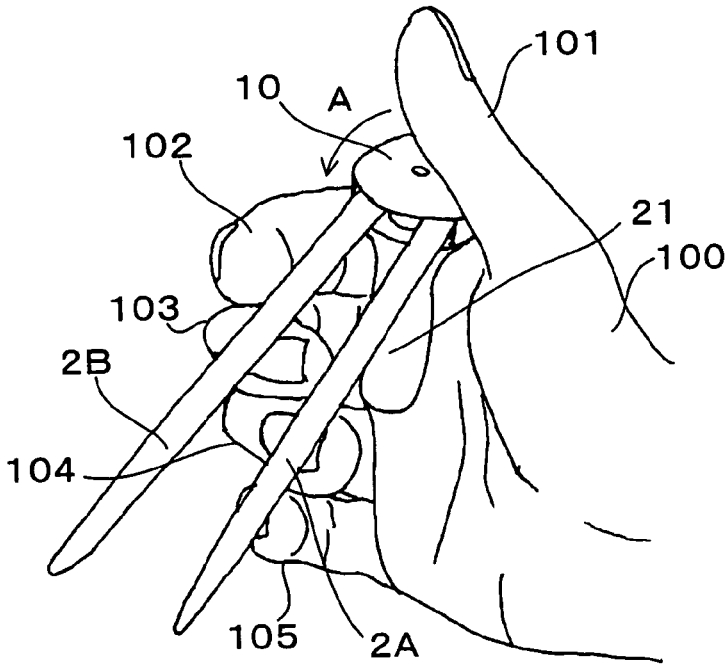
FIG. 10 is a view showing a state where the user puts his or her fingers to the chopsticks, which is subsequent to the state shown in FIG. 9.
Figure 11:
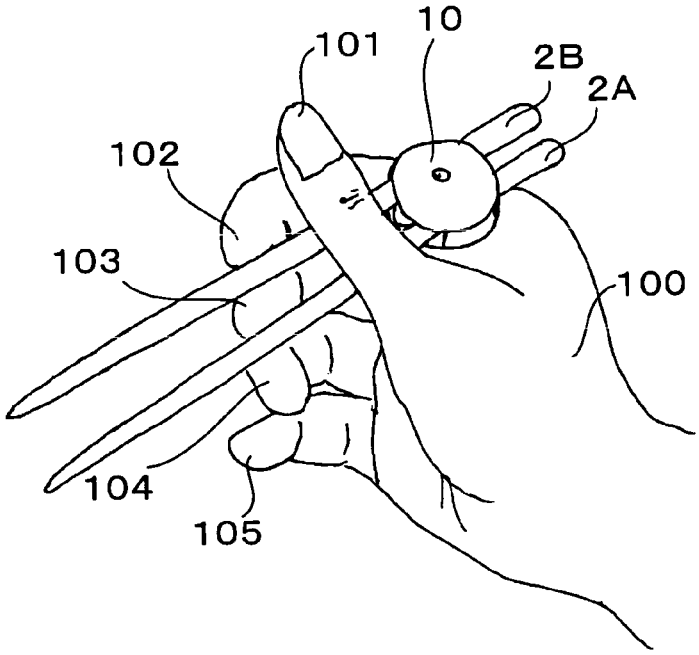
FIG. 11 is a view showing a state where the user further puts his or her thumb to the chopsticks, which is subsequent to the state shown in FIG. 10.
Figure 12:
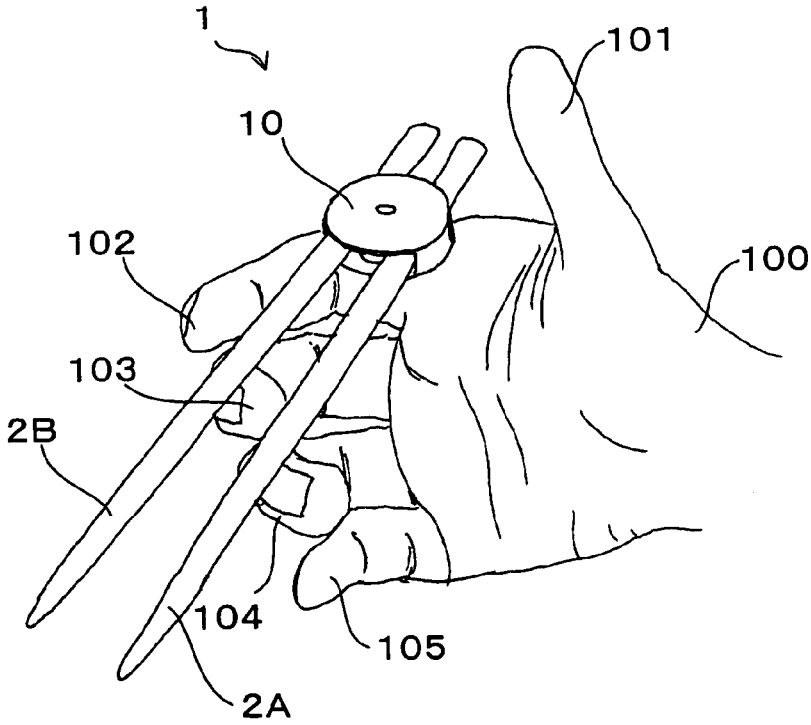
FIG. 12 is a view showing a state where a user uses chopsticks without the supporter, which corresponds to the state shown in FIG. 9.

After the supporter 20 is attached to the adapter 10, as shown in FIG. 9, the user positions the assist tool 1 by fitting the finger fitting portion 21 of the supporter 20 to the vicinity of the base of the forefinger 102 of his or her hand 100. In that state, a sufficient spacing is provided between the lower chopstick 2A and the upper chopstick 2B inserted into the adapter 10 by a restoring force of the spring portion 12*b* of the adapter spring 12, so that the user can put his or her forefinger 102 and long finger 103 to the upper chopstick 2B and he or she can put his or her annular finger 104 to the lower chopstick 2A naturally and reasonably, as shown in FIG. 10. Thereafter, as shown with arrow A in FIG. 10, the user can hold the chopsticks 2A and 2B correctly by putting the inside of his or her thumb on the upper chopstick 2B, as shown in FIG. 11.

According to the above described usage, the chopsticks 2A and 2B are coupled by the adapter 10 at a right positional relationship, and the chopsticks 2A and 2B can be supported stably in a correct position in a user's hand. Accordingly, even a user who is unskilled in using chopsticks can use chopsticks easily and correctly.

When a user in the course of learning how to use chopsticks adjusts to how to hold the chopsticks 2A and 2B to such an extent that the user does not require assistance from the supporter 10, the supporter 20 is detached from the adapter 10, so that the user can directly put the adapter 10 to the vicinity of the base of his or her forefinger 102 to hold the chopsticks 2A and 2B. Further, when the user adjusts to how to use the chopsticks to such an extent that the user does not require assistance from the adapter 10, the chopsticks 2A and 2B are detached from the adapter 10, so that the user can train how to use the chopsticks using only the chopsticks 2A and 2B.

Thus, according to the illustrated assist tool 1, a user can learn how to use chopsticks according to the three stages described above. Incidentally, the assist tool 1 is not applied to only training for a toddler, but it can provide a proper assistant function to various users who cannot skillfully use chopsticks by utilizing the adapter 10 and the supporter 20.

The present invention is not limited to the above embodiment, but it may be implemented with various aspects. For example, the adapter 10 can be constituted to couple the chopsticks 2 to each other at least such that they can be opened and closed, and it can be modified in shape properly. The adapter spring 12, that is spring means can be obtained by forming a spring material in a loop shape or U shape. The spring portion 12*b* of the adapter spring 12 may be omitted as far as the bearing portion 12*a* can urge the chopsticks 2. The finger putting face 21*a* of the finger fitting portion 21 of the supporter 20 may properly be changed in its shape. Antislip means may be provided on the finger putting face 21*a*.

What is claimed is:

1. An assist tool for chopsticks comprising: an adapter which couples upper and lower chopsticks such that distal end portions thereof can be opened and closed about rear end portions thereof serving as fulcrums; and a supporter which is fitted to a vicinity of a base of a forefinger of a user to support the adapter on the base, wherein, the adapter is provided with an adapter main body and an adapter spring disposed inside the adapter main body, the adapter main body has a pair of side walls of which inner faces are constituted as chopstick receiving faces and a chopstick inserting space in which the adapter spring is disposed, and clearances are formed between the adapter spring and the side walls in which the rear end portions of the chopsticks are inserted to thereby be sandwiched between the adapter spring and the chopstick receiving faces, and the supporter includes a finger fitting portion and a supporting portion provided thereon to be coupled to the adapter, and the finger fitting portion curved in a generally inverted U shape so as to fit to the vicinity of the base of the forefinger.

2. The assist tool for chopsticks according to claim 1, wherein the supporter is attachable to and detachable from the adapter.

3. The assist tool for chopsticks according to claim 1, wherein an attaching position of the supporter to the adapter can be changed about the fulcrums of the chopsticks.

4. The assist tool for chopsticks according to claim 1, wherein the upper and lower chopsticks are attachable to and detachable from the adapter.

5. The assist tool for chopsticks according to claim 1, wherein the chopsticks are urged by the adapter spring such that the distal end portions thereof are opened.

6. An assist tool for chopsticks comprising: an adapter which couples upper and lower chopsticks such that distal end portions thereof can be opened and closed about rear end portions thereof serving as fulcrums; and a supporter which is fitted to a vicinity of a base of a forefinger of a user to support the adapter on the base, wherein, the adapter is provided with an adapter main body and an adapter spring disposed inside the adapter main body, the adapter main body has a pair of side walls of which inner walls are constituted as chopstick receiving faces and a chopstick inserting space in which the adapter spring is disposed, and the rear end portions of the chopsticks are inserted in clearances formed between the adapter spring and the side walls to thereby be sandwiched between the adapter spring and the chopstick receiving faces, the chopsticks are urged by the adapter spring such that the distal end portions thereof are opened, and a coupling shaft to be inserted to the chopstick inserting space of the adapter is provided on the supporting portion of the supporter, and the adapter spring has a hollow bearing portion fitted to the coupling shaft in the chopstick inserting portion and a spring portion disposed nearer than the distal end side of the chopsticks than the bearing portion to thereby urge the chopsticks to the chopstick receiving faces of the adapter.

* * * * *